US006966743B2

(12) United States Patent
Eugster

(10) Patent No.: US 6,966,743 B2
(45) Date of Patent: Nov. 22, 2005

(54) DEVICE FOR PUSHING A STACK OF PRINTED PRODUCTS FROM A TABLE

(75) Inventor: Albert Eugster, Strengelbach (CH)

(73) Assignee: Müller Martini Holding AG, Hergiswil (CH)

( * ) Notice: Subject to any disclaimer, the term of this patent is extended or adjusted under 35 U.S.C. 154(b) by 63 days.

(21) Appl. No.: 10/440,558

(22) Filed: May 15, 2003

(65) Prior Publication Data

US 2003/0215322 A1 Nov. 20, 2003

(30) Foreign Application Priority Data

May 17, 2002 (EP) ..... 02405400

(51) Int. Cl.[7] ..... B65G 57/00

(52) U.S. Cl. ..... 414/790.3; 414/788.9; 414/789; 414/789.1; 414/900

(58) Field of Search ..... 414/788.3, 788.9, 414/789, 789.1, 790.3, 791.3, 791.4, 900

(56) References Cited

U.S. PATENT DOCUMENTS

| | | | | |
|---|---|---|---|---|
| 3,532,230 A | | 10/1970 | Gutberlet et al. | |
| 3,595,370 A | * | 7/1971 | Fujishiro | 198/374 |
| 3,599,807 A | * | 8/1971 | Hedrick et al. | 414/788.3 |
| 4,055,245 A | * | 10/1977 | Sundberg | 414/788.3 |
| 4,068,567 A | | 1/1978 | Allison et al. | |
| 4,103,785 A | * | 8/1978 | Wiseman | 414/788.3 |
| 4,725,180 A | * | 2/1988 | Kasamatsu et al. | 414/788.3 |
| 4,749,077 A | * | 6/1988 | Sjogren | 198/412 |
| 5,433,582 A | * | 7/1995 | Medina | 414/788.3 |
| 6,692,220 B2 | * | 2/2004 | Pluss et al. | 414/790.3 |

FOREIGN PATENT DOCUMENTS

| | | |
|---|---|---|
| CH | 567996 | 10/1975 |
| EP | 0153983 | 9/1985 |
| FR | 2806396 | 9/2001 |

* cited by examiner

*Primary Examiner*—Douglas Hess
(74) *Attorney, Agent, or Firm*—Friedrich Kueffner

(57) ABSTRACT

A device for pushing a stack of printed products from a table on which the stack is stacked has a stacking receptacle provided on the table and receiving the printed products for stacking. The stacking receptacle is defined by four lateral edges of the printed products and has two opposed lateral guide walls viewed in a pushing direction of pushing out the stack of printed products. The guide walls each have vertical guide rails moveable along the guide walls in the pushing direction. The guide rails on the opposed guide walls are positioned opposite one another in guide rail pairs forming a forward receptacle boundary and a rearward receptacle boundary in the pushing direction. The rearward receptacle boundary in the pushing direction is a pushing device for the stack of printed products.

20 Claims, 4 Drawing Sheets

DEVICE FOR PUSHING A STACK OF PRINTED PRODUCTS FROM A TABLE

BACKGROUND OF THE INVENTION

1. Field of the Invention

The invention relates to a device for pushing a stack of printed products off a table out of a stacking receptacle determined by four lateral edges of the printed products.

2. Description of the Related Art

EP 0 153 983 B1 discloses a device of the aforementioned kind in which the individually fed printed products are stacked on a table in a stacking receptacle and are removed from the table as a stack.

This device requires a relatively high expenditure for adjusting and converting a cross-section of the stacking receptacle, viewed in the loading direction, as well as of the auxiliary pushing device.

SUMMARY OF THE INVENTION

It is an object of the present invention to provide a device of the aforementioned kind which makes it possible to simplify the adjustment and conversion of the cross-section of the stacking receptacle and realize this without requiring manual action and to combine the pushing action with the stacking receptacle.

In accordance with the present invention, this is achieved in that the staking receptacle, viewed in the pushing direction, is provided with two oppositely positioned lateral sidewalls along which a vertical guide rail can be driven, which forms together with the oppositely positioned one a leading (forward) or rearward receptacle boundary, and in that the rearward guide rail pair, viewed in the pushing direction, is formed as a pushing device. In this way, the stack is guided and secured across the entire pushing length over its entire stack height. Accordingly, when pushing out the stacks from the stacking receptacle, the stacks can be guided by the stacking receptacle itself.

DESCRIPTION OF THE PREFERRED EMBODIMENTS

Figure 1:
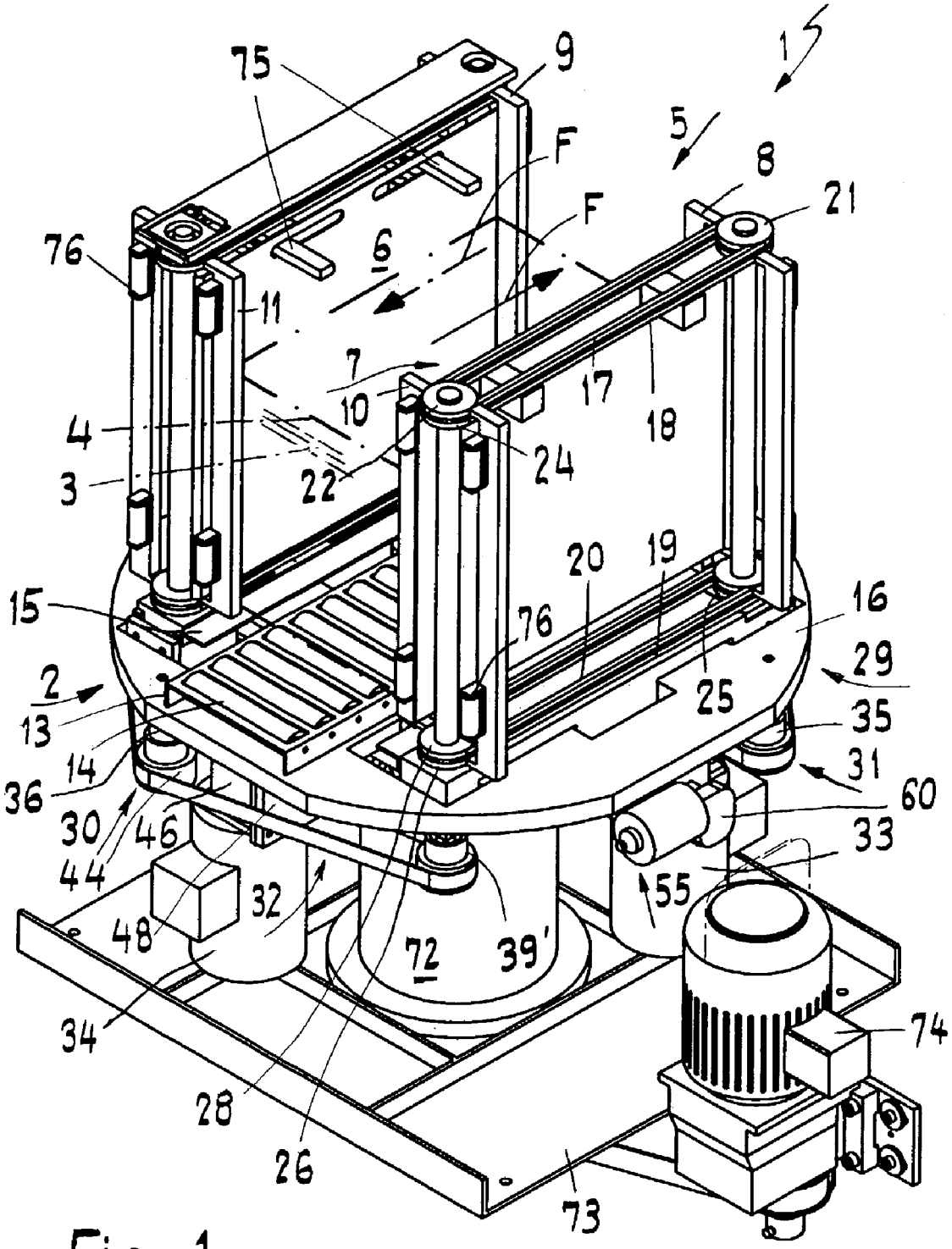
FIG. 1 shows a perspective view of the device according to the invention.

FIG. 1 illustrates a device 1 for pushing out a stack of printed products 3 stacked on a table 2 at the end of a stacking receptacle 5, wherein the stack 4 is illustrated in dash-dotted lines. The end of the stacking receptacle 5, from where the printed products 3 can be removed in two opposite directions F, F', is comprised—viewed in the pushing direction F, F'—of two opposite lateral sidewalls 6, 7, which must not be mandatorily provided as complete solid walls. Along the sidewalls 6, 7, vertical guide rails 8, 9; 10, 11 are driveable in the pushing direction F, F'; the guide rails form together with the oppositely positioned guide rails a forward (leading) and rearward receptacle boundary. In the pushing direction F, the guide rails 8, 9 form a forward receptacle boundary and the guide rails 10, 11 form a rearward receptacle boundary or a pushing device 12. In the opposite pushing direction F', the guide rails 8, 9 form the rearward receptacle boundary or the pushing device.

The table 2 forming a support for the stack 4 is a roller table 2 comprised of several conveying rollers 14, which are positioned sequentially behind one another in the pushing direction F, F' and are freely rotatably supported in a frame 13. The table 2 is provided with lateral support rails 15 and forms a planar support surface between the sidewalls 6, 7.

The roller table 2 is supported on a rotary frame 16 to be described in the following.

The guide rails 8 through 11, which match at least the stacking height, circulate about vertical axes that, viewed in the pushing direction, are located at the ends of the sidewalls. For this purpose, the upper and the lower end of a guide rail 8 through 11 is attached to an endless toothed belt 17, 18 or 19, 20 or a link chain, respectively, which are guided on driven deflection rollers 21 through 28 or 21' through 28'. On the upper end or the lower end of a vertical axis correlated with one of the sidewalls (guide walls) 6, 7, deflection rollers 21 through 28 or 21' through 28' are positioned on the opposite sidewalls 7, 6 correlated with the toothed belt 17 through 20 for the guide rails 8 through 11 forming the leading receptacle boundary or the rearward receptacle boundary. This is illustrated in FIG. 2.

Figure 2:
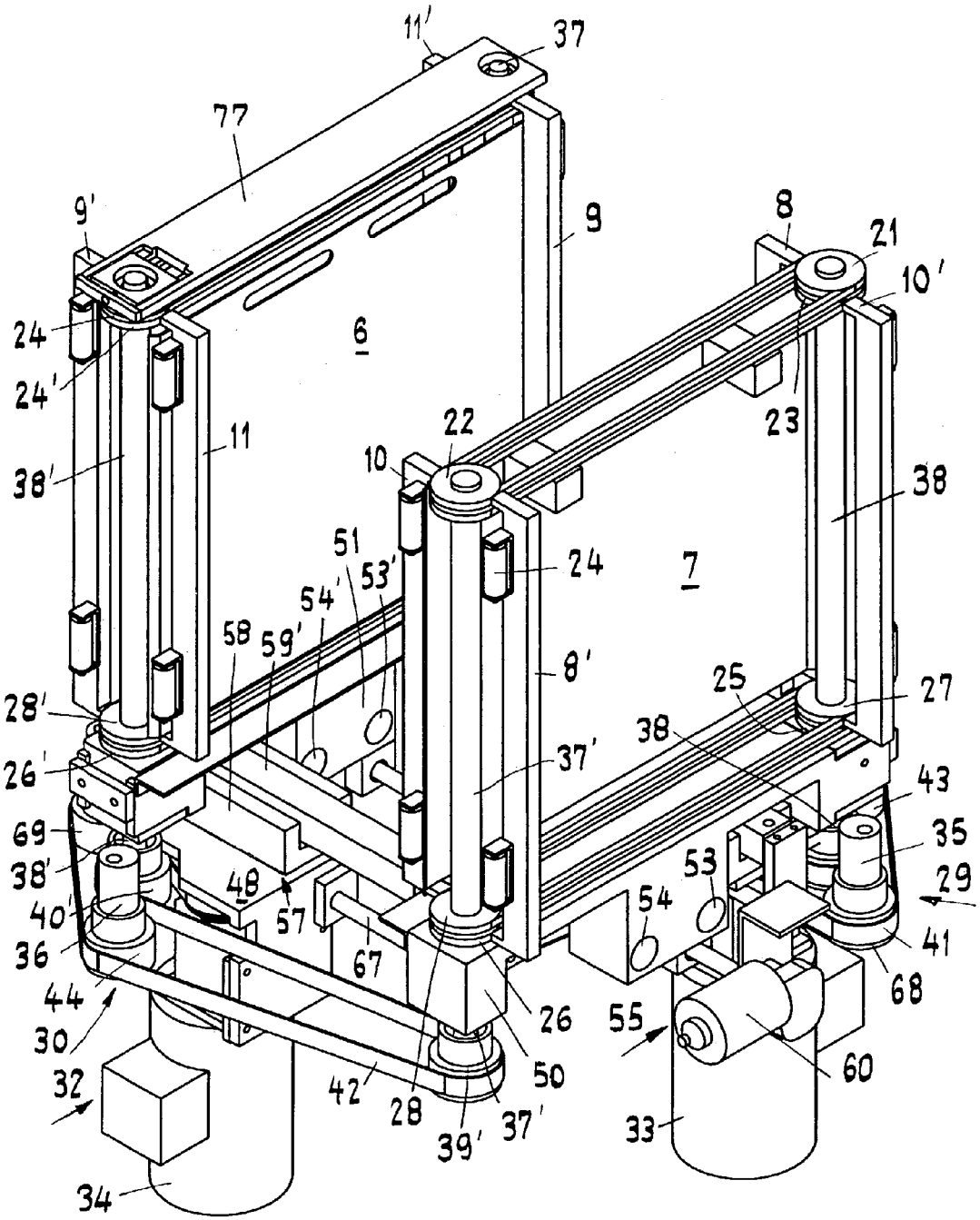
FIG. 2 shows a magnified perspective illustration of the device according to the invention for forming a stack from printed products.
Figure 3:
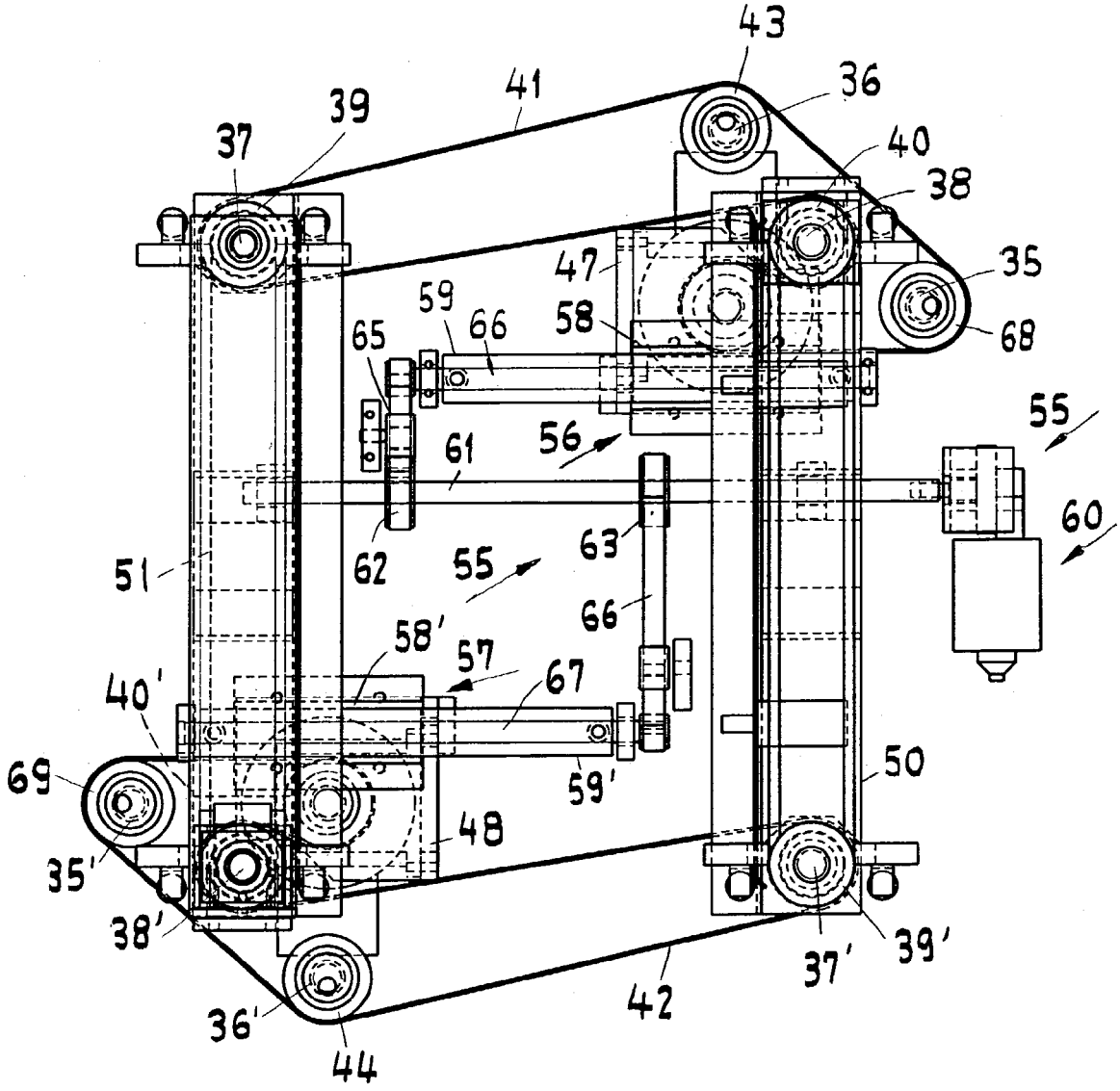
FIG. 3 shows a plan view onto the device according to FIG. 2.
Figure 4:
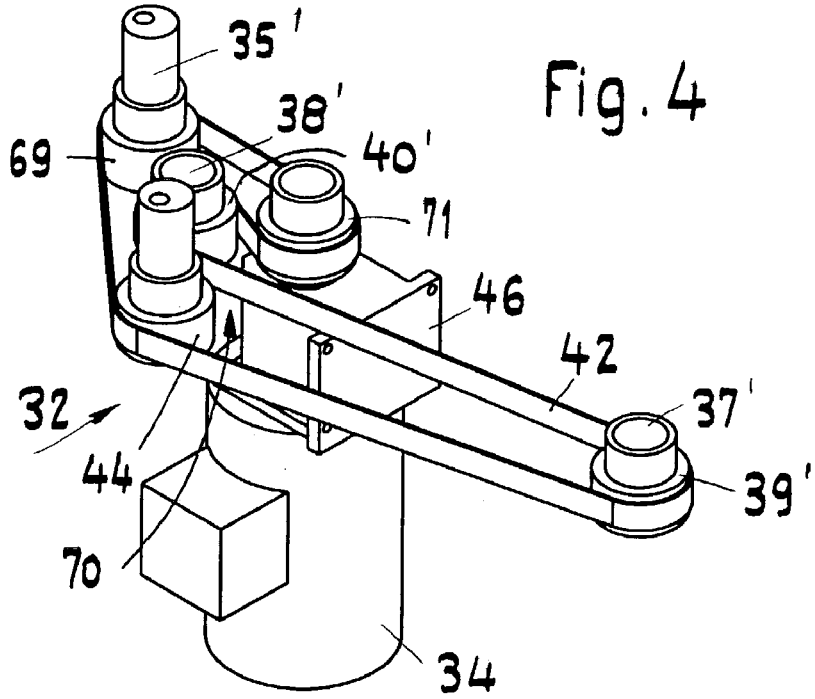
FIG. 4 shows a perspective illustration of a drive device of a device forming a stacking receptacle provided for pushing out the stack from the stacking receptacle.
Figure 5:
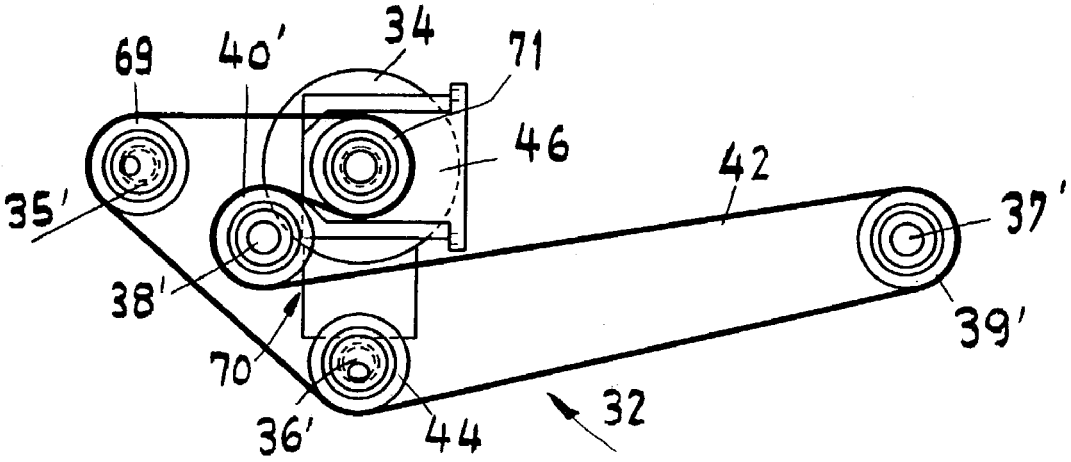
FIG. 5 shows a plan view onto the drive device illustrated in FIG. 4.

In FIG. 1 as well as in FIG. 2, with respect to the pushing direction F, the lowermost and the uppermost deflection rollers 21, 22 and 25, 26 or 21', 22' and 25, 26' are provided for the guide rails 8, 9 forming the leading receptacle boundary, while the deflection rollers 23, 24, 27, 28 or 23', 24', 27', 28' directly neighboring the deflection rollers 21, 22, 25, 26 or 21' 22' 25' 26' are correlated with the rearward receptacle boundary or the pushing device 12. The guide rails 8, 9 or 10, 11 forming the forward receptacle boundary, respectively, or the rearward receptacle boundary or the toothed belts 17 through 20 or 17' through 20' are connected to a drive device 29, 30, respectively. The drive devices 29, 30 have a toothed belt gear 31, 32 and are driven in a controlled fashion synchronously or separately, i.e., they have drive motors 33, 34 which have a rotary angle control. FIG. 3 shows both drive devices 29, 30, while FIGS. 4 and 5 show the drive device 30 separately.

In order to be able to employ the circulating toothed belts 17 to 20 or 17' to 20' in an optimal way, at half their length further guide rails 8' through 11' are attached, respectively, so that after a pushing-out step the following guide rails 8' to 11' form a stacking receptacle.

Each sidewall (guide wall) 6, 7 of the stacking receptacle 5 has arranged at the ends viewed in the pushing direction F, F' two pulling or traction means 17 through 20 or 17' through 20', respectively, which circulate about vertically extending axes. One pair is arranged at the upper end area and at the lower end area of the guide rails 8 through 11 or 8', respectively. The pulling means 17 through 20 or 17' through 20' circulate on deflection rollers 21 through 28 or 21' through 28'.

The guide rails 8, 9, 10, 11 forming the forward and rearward receptacle boundaries, when viewed in the pushing direction F, F', are connected drivingly to both drive devices 29, 30 and can be used synchronously for the pushing process and independently for the adjustment of the receptacle to the product size in the pushing direction F, F'. In FIGS. 1 and 2, the deflection rollers 22, 22' and 26, 26' are fixedly connected to the drive shafts 37', 38', while the deflection rollers 25, 25' that are drivingly connected by the pulling means 17, 19, 17', 19' to the deflection rollers 22, 22' and 26, 26' are arranged freely rotatable on the shafts 37, 38. The drive shafts 37, 38 are fixedly connected to the deflection rollers 23, 27 and 23', 27' while the deflection rollers 24, 28 and 24', 28', drivingly connected to the pulling means 18, 20 and 18', 20', are arranged freely rotatable on the drive shafts 37, 38'.

Of course, the deflection rollers 24, 28 and 24', 28' can be connected with the drive shafts 37', 38'.

The toothed belt gears 31, 32 of the drive devices 29, 30 are arranged on the underside of the rotary frame 16 by means of bearing supports 35, 36 and about two drive shafts 37, 38, 37', 38' of the guide rails 8 through 11 or 8' through 11' positioned opposite one another in a direction transverse to the pushing direction F, F'; two deflection rollers 39, 40, 39', 40' are drivingly connected thereto, respectively. On the bearing supports 35, 36, 35', 36' freely rotating support rollers 43, 44 are supported which support a toothed belt 41, 42.

The drive motors 33, 34 of the toothed belt gears 31, 32 are suspended by means of an intermediate gear 45, 46 from a support 47 (not visible, 48) that is connected to the rotary frame 16. The supports 47, 48, in turn, are connected to a support frame 49 which has a support 50, 51 correlated with the sidewall 6, 7, respectively. In the supports 50, 51, the drive shafts 36, 36', 37, 37' of the guide rails 8 through 11 are supported. They are movably supported on guide rods (not illustrated) of a guide arrangement that are arranged in a direction transverse to the pushing direction F, F' and are anchored in the rotary frame 16.

FIG. 2 shows bores 53, 53', 54, 54' which are penetrated by the guide rods fastened on the rotary frame 16 for movement of the supports 50, 51. The supports 50, 51 of the support frame 49, for changing the spacing between the sidewalls 6, 7, are driven by a spindle drive 55 for approaching one another and moving away from one another. For this purpose, a telescopically driven guide device 56, 57 is provided which is comprised of two guide parts 58, 59 or 58' 59' that are relatively movable on one another. One (58, 58') forms a guide groove for receiving the other. The guide parts 58, 59 and 58', 59' are connected to the support frame 49, and the guide part 58, 58' are suitable for attachment of the supports 47, 48 on which the drive motor 33, 34 of a drive device 29, 30 is suspended so that the toothed belts 41, 42 remain tensioned by compensation upon adjustment of the guide walls 6, 7.

For the adjustment of the guide walls 6, 7 such that uniform lateral spacing relative to the removal axis of the stack 4 is provided, the spindle drive 55 is provided (see FIGS. 1 through 3). It is comprised of a gear motor 60 fastened on the rotary frame 16; a shaft 61 supported on the rotary frame 16 in a position extending transversely to the pushing direction F, F' is in driving connection with the gear motor 60 (FIG. 3). On this shaft 61, a pulley 62, 63 for a lateral adjustment of the guide walls 6, 7 and of the stacking receptacle 5 is provided, respectively. The pulleys are drivingly connected by means of toothed drive belts or a chain 64, 65 with a spindle rod 66, 67 provided for moving the guide walls 6, 7, wherein the spindle rods 66, 67 have oppositely acting threads, i.e., a left-handed thread and a right-handed thread. Because of the oppositely oriented movements of the guide walls 6, 7 or of the supports 50, 51 of the support frame 49, the toothed belt 41, 42 guided through a compensation loop remains tensioned.

FIG. 1 also shows a device 1, which is embodied as a compensating stacker, having at its underside a drum 72 that is fixedly connected to the rotary frame 16 and is supported on a machine frame 73 and in driving connection with a stationary electric motor 74. The stacked partial stacks which are stacked alternatingly in an arrangement rotated by 180 degrees, can be pressed before being moved out by lifting the roller table 2 against counter elements 75 that can be moved by the guide walls 6, 7 into the stacking receptacle 5. For this purpose, the roller table 2 can be lifted and lowered.

On the sides of the guide rails 8 through 11 facing away from a stake 4 of printed products 3 positioned in the stacking receptacle 5, support members 76 are fastened at the top and at the bottom; the support members 76 are positioned, when the stack 4 is pushed out of the stacking receptacle 5, on the side of the guide walls 6, 7 facing the stack 4.

The drive shafts 37, 38 and 37', 38' correlated with one of the guide walls 6, 7, respectively, are supported at their upper end in a plate 77 connecting the drive shafts.

While specific embodiments of the invention have been shown and described in detail to illustrate the inventive principles, it will be understood that the invention may be embodied otherwise without departing from such principles.

What is claimed is:

1. A device for pushing a stack of printed products from a table on which the stack is stacked, the device comprising:

a stacking receptacle provided on a table and receiving the printed products for stacking;

wherein the stacking receptacle has two opposed lateral guide walls viewed in a pushing direction of pushing out the stack formed of the printed products;

wherein vertical guide rails are moveable along the guide walls, respectively, in the pushing direction;

wherein the guide rails on the opposed guide walls are positioned opposite one another in guide rail pairs forming a forward receptacle boundary and a rearward receptacle boundary in the pushing direction;

wherein the rearward receptacle boundary in the pushing direction forms a pushing device;

wherein the guide rail pairs each are connected to pulling means driven in circulation about vertical axes, in the pushing direction, the guide rails of the forward receptacle boundary and of the rearward receptacle boundary having an upper end and a lower end and are fastened with the upper and lower ends to the pulling means, respectively, and wherein the pulling means neighbour the lower end and the upper end of the guide rails provided for the forward receptacle boundary and the rearward receptacle boundary, respectively.

2. The device according to claim 1, wherein the pulling means are configured as toothed belts.

3. The device according to claim 1, wherein the guide rail pairs forming the forward receptacle boundary or the rearward receptacle boundary have drive devices correlated therewith, respectively, wherein the drive devices are controlled synchronously for ejecting and separately for displacing.

4. The device according to claim 3, wherein the drive devices have a drive shaft, respectively, having an upright axis, wherein on the drive shaft of a first one of the drive devices two deflection rollers are fixedly fastened and are connected by the pulling means to two freely rotatable deflection rollers arranged on the drive shaft of a second one of the drive devices.

5. The device according to claim 3, wherein on the pulling means provided for the forward and the rearward receptacle boundaries, respectively, two of the guide rails correlated with one of the guide walls are fastened uniformly spaced to one another, respectively.

6. The device according to claim 3, wherein the pulling means and the guide rails forming the forward and the rearward receptacle boundaries, respectively, are drivingly connected with one of the drive devices, respectively.

7. The device according to claim 6, wherein the guide rails forming the pushing device have one of the drive devices.

8. The device according to claim 6, wherein the drive devices have a motor and are configured as a toothed belt gear circulating about vertical axes.

9. The device according to claim 6, wherein the guide rails forming the forward receptacle boundary have one of the drive devices.

10. The device according to claim 3, wherein the pulling means circulate about vertical axes located at ends of the guide walls viewed in the pushing direction.

11. The device according to claim 10, wherein two of the vertical axes of the guide rails positioned opposite one another in a direction transverse to the pushing direction are correlated with one of the drive devices, respectively.

12. The device according to claim 10, further comprising a support frame having a guide arrangement and supports movable transversely to the pushing direction on the guide arrangement, wherein vertical axes correlated with one of the guide walls are arranged on one of the supports for changing a spacing of the guide walls relative to one another, respectively.

13. The device according to claim 12, further comprising a spindle drive having oppositely acting spindle rods, wherein the supports of the support frame are in driving connection with the spindle rods.

14. The device according to claim 13, wherein the drive devices have a motor, respectively, wherein the motors are connected to guides arranged on the support frame and telescopingly movable parallel to the movement of the supports.

15. The device according to claim 14, wherein the motors are connected to the supports of the support frame and are movable, proportionally to a change of a spacing of the guide walls, by means of a gear connected to the spindle drive.

16. The device according to claim 15, further comprising a rotary frame driveable in rotation about a vertical axis of rotation, wherein the support frame is fastened by the guide arrangement to the rotary frame.

17. The device according to claim 16, wherein the pulling means circulate about vertical axes located at ends of the guide walls viewed in the pushing direction, wherein the motors are drivingly connected by a toothed belt gear to two of the vertical axes positioned opposite one another in a direction transverse to the pushing direction, respectively.

18. The device according to claim 17, wherein the toothed belt gear is in driving connection with deflection rollers supported on the two vertical axes positioned opposite another and with rollers supported on the rotary frame or on support rollers.

19. The device according to claim 18, wherein a section of a toothed belt of the toothed belt gear between the two vertical axes positioned opposite one another and a section of the toothed belt between one of the two vertical axes and a drive wheel of the motor form a compensation loop that is variable as a function of a spacing between the guide walls.

20. The device according to claim 1, wherein the pulling means are link chains.

* * * * *